United States Patent [19]

Pierson et al.

[11] 4,274,088

[45] Jun. 16, 1981

[54] PORTABLE ALARM SYSTEM

[76] Inventors: Don H. Pierson, P.O. Box 1849, Sedona, Ariz. 86336; Robert D. Pierson, 10943 N.E. 133rd St., Kirkland, Wash. 98033

[21] Appl. No.: 153,169

[22] Filed: May 27, 1980

[51] Int. Cl.[3] ..... G08B 13/14

[52] U.S. Cl. ..... 340/568; 340/666; 200/42 R

[58] Field of Search ..... 340/568, 571, 626, 665, 340/666, 686, 687; 200/42 R

[56] References Cited

U.S. PATENT DOCUMENTS

| | | | |
|---|---|---|---|
| 3,303,592 | 2/1967 | Harner | 340/568 |
| 4,150,371 | 4/1979 | Scaglione | 340/568 |

*Primary Examiner*—Alvin H. Waring

*Attorney, Agent, or Firm*—Gregory J. Nelson

[57] ABSTRACT

A portable alarm particularly useful for protecting works of art in art galleries and museums is a self-contained alarm system in a display base member. The alarm is energized in response to the operation of either of two switches, in turn activated by spring biased plungers normally biased to extend out of the bottom and top surfaces, respectively, of the base member. When the base member is placed on a support such as a table, one of the switches is deactivated. When a work of art is placed on the top of the base member, the other switch plunger is depressed and its associated switch is deactivated. The alarm then is enabled for operation by a key operated switch connected in series circuit with the alarm and a silicon controlled rectifier (SCR). Removal of the art object from the top of the portable alarm base member or removal of the base member with the object placed on it, permits either one or the other of the plungers to be biased to the protruding position out of the surface into which it is normally depressed when the alarm is placed in its "set" position. This causes the alarm to be energized, alerting personnel to the fact that someone has tampered with it or with the object placed on top of it.

10 Claims, 4 Drawing Figures

PORTABLE ALARM SYSTEM

BACKGROUND OF THE INVENTION

Art galleries, museums, jewelry stores and gift shops often display valuable works of art or articles for sale such as sculptures, pieces of jewelry, and the like, in the open where they can be seen best and admired by viewers and prospective purchasers. When precious pieces of art are placed in or behind obtrusive glass cases, the viewing of the pieces so located is considerably impaired. A problem exists, however, with the placement of valuable pieces of art, particularly small pieces, on display in the open in the increased incidence of thefts of such openly displayed sculptures, jewelry, and the like, from galleries, museums, and stores using such a display technique.

Systems have been developed for use in art galleries and museums which generally provide an intrusion protection against break-in from the outside during the times the museums or galleries are closed. Such alarm systems, obviously, are worthless during normal business hours when they are deactivated in order to permit the normal operation of the business.

Many museums and some art galleries have displays wired into a permanently wired alarm system which includes various sensors, switches, and the like, activated whenever a piece protected by the system is moved. Permanently wired systems, however, are expensive and relatively inflexible. If a rearrangement of the gallery or frequent changing of displays and types of displays is desired, permanently wired systems, at any cost, are not a practical solution to providing alarm protection against thefts of the works of art on display.

Self-contained alarm units, either built into a briefcase, box, or the like, or included as part of a separate base, have been developed in the past. One such alarm is disclosed in the patent to Stelter, U.S. Pat. No. 2,797,405. This patent discloses a jewelry box or similar article with a pin extending through a hole in the bottom of the box. The pin is of sufficient length to rest against the inside of the lid of the box when the lid is closed and extends through the bottom of the box. A special base, including the alarm components, is provided onto which the box is placed. The pin extends through a hole in the upper surface of the base to normally press against a spring biased switch contact, holding the switch in an open circuit position. An alarm is connected in series with the switch and a battery. If the lid is opened, the pin is pushed upwardly by means of the spring bias of the switch, permitting the switch to close and energize the alarm. Similarly, if the box is picked up off the base, the pin is removed and the spring closes the switch with the same result. The alarm requires a specially constructed box for containing the valuables to be protected, and in addition, requires use of that box with the specially constructed base, including the alarm components.

Other types of movement actuated alarm switches are disclosed in a variety of patents, a typical one of which is the patent to Bennett, U.S. Pat. No. 3,685,037, issued Aug. 15, 1972. This patent discloses a spring biased switch extending through a base support connected to the bottom of a business machine. If the machine is lifted, the spring biased switch closes and activates an electronic circuit to engage a buzzer alarm. The alarm can be deactivated subsequently only by opening a key operated switch in the series circuit of the alarm circuit.

Various types of audible and visual alarms utilizing built-in switches in specially constructed boxes, or utilizing pressure depressed spring biased switches in the bottom of display racks, and the like, have been used in the past.

A disadvantage with the prior art alarm devices is that they either are not self-contained or if they are, the alarms themselves are constructed as an integral part of a specially constructed box or the like for containing valuables. In the case of alarms for display racks, the rack itself is specially constructed; and if the rack and the object being protected are simultaneously moved, no alarm is sounded.

It is desirable to provide a relatively small, inexpensive, self-contained, portable alarm which may be used for protecting openly displayed valuable articles and which may be activated when either the article is removed or when the article and the alarm unit are removed together. It is desirable particularly to provide for a portable self-contained alarm which may be used without restriction wherever an article of art or the like is desired to be displayed.

SUMMARY OF THE INVENTION

Accordingly, it is an object of this invention to provide an improved alarm system.

It is another object of this invention to provide an improved portable alarm system.

It is an additional object of this invention to provide an improved portable, self-contained alarm system.

It is a further object of this invention to provide an improved portable, self-contained alarm system, particularly useful in art galleries for protecting against the theft of objects of art.

It is a more specific object of this invention to provide an improved portable alarm system in the form of a self-contained alarm base member to be placed beneath the object to be protected, so that the alarm is activated when either the object is removed from the alarm unit or the alarm unit and the object together are removed from the underlying support.

In accordance with a preferred embodiment of this invention, a portable alarm system for protecting exposed valuables comprises an alarm housing base member which has a lower surface for placement on an underlying support member and which has an upper article support surface spaced from the lower surface. An alarm system is placed within the base member and is self-contained. A first sensor is placed in the lower surface of the base member to enable the alarm whenever the base member is removed from the underlying support member. A second sensor is located in the upper support surface of the alarm base member and is operated to enable the alarm whenever an object or article is removed from the upper support surface of the base member.

DETAILED DESCRIPTION

Figure 1:
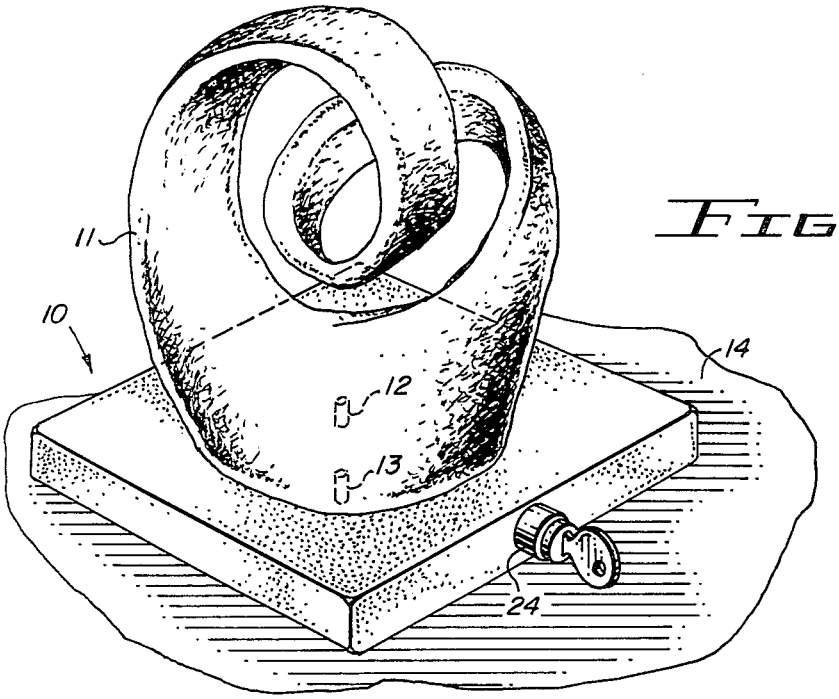
FIG. 1 is a perspective view of a preferred embodiment of the invention with an article of art placed on it.

Reference now should be made to the drawing in which the same reference numbers are used in the different Figures to designate the same or similar components.

Referring first of all to FIG. 1, the self-contained portable alarm unit 10 is illustrated with a work of art 11 located on its upper surface. When the work of art 11 is so located, a spring biased plunger 12 of a microswitch, which is located to normally protrude through the upper surface of the unit 10, is depressed by the weight of the article 11 placed on the alarm unit. The lower or base surface of the alarm unit 10 has a similar spring biased switch plunger 13 normally protruding out of it, except that when the alarm unit 10 is placed on a table or other support surface or support member, the plunger 13 is depressed into the alarm unit 10.

When both of the plungers 12 and 13 are depressed into the alarm unit, a key operated switch 24 is turned to "arm" or activate the alarm unit for operation. When the alarm unit 10 is to be moved to another location or a different object of art is to be placed on it, the key switch 24 is turned to a "disarm" or deactivate position, and the alarm will not operate. It then can be moved or new objects of art may be placed upon it, after which the alarm is reactivated for use.

Figure 2:
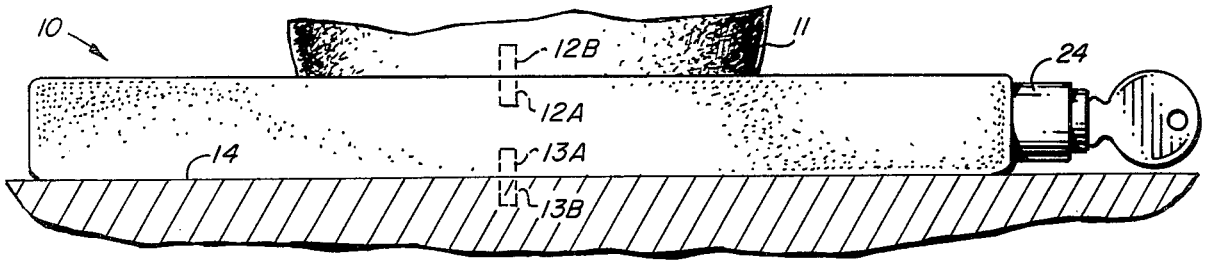
FIG. 2 is a side elevation representation of some of the features of the embodiment shown in FIG. 1.

FIG. 2 shows the relative locations of the alarm unit 10, an underlying support table 14, and the work of art 11 placed upon the alarm unit. The positions 12A and 13A of the plungers 12 and 13, illustrated in FIG. 2, are the positions occupied by these plungers when the alarm is in its "set" condition of operation. The positions 12B and 13B, the extended positions of the plungers 12 and 13, are the positions which these plungers attain under the urging of spring bias provided within the alarm unit 10. Whenever the object of art 11 is removed from the top of the alarm unit 10, the plunger 12 moves to the position 12B. Alternatively, if the alarm unit 10 is lifted from the table 14 along with the object of art 11, the plunger 13 moves to the position 13B, shown in FIG. 2. When either of the plungers 12 or 13 move to the positions 12B or 13B, the alarm is triggered into its active state and a buzzer, or a light, or both, is energized to warn the operators of the gallery or the curators of the museum of such fact of movement. Appropriate steps then can be taken to apprehend the would-be thief.

The box 10, which houses the alarm, may be made of any suitable materials in appropriate sizes selected to display pieces of sculpture, jewelry, or the like. Commerical versions of the alarm are housed in aluminum boxes 10 made of 0.080 aluminum. Sizes which have been found practical for art galleries and museums are constructed seven inches by seven inches by one and five sixteenths inches (7"×7"×1 5/16") and nine inches by thirteen inches by one and five sixteenths inches (9"×13"×1 5/16"). The box itself then typically is covered over with velvet or fleece fabric in dark brown or black material. A small hole is formed in both the top and bottom surfaces of the case and fabric to permit the pins or plungers 12 and 13 to protrude beyond the planes of these surfaces of the unit 10.

Figure 3:
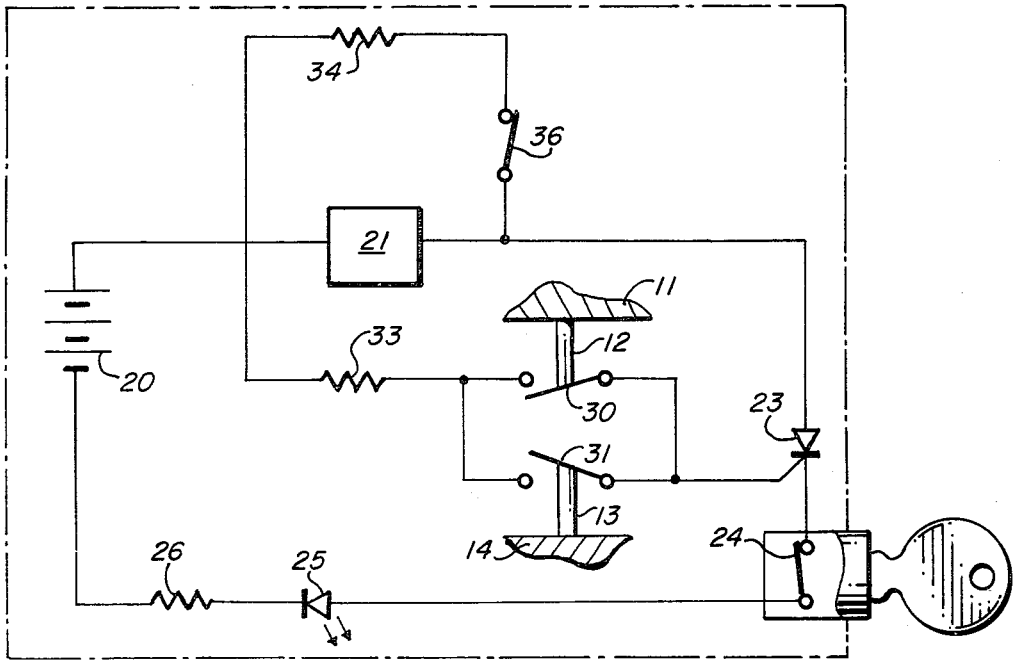
FIG. 3 is a schematic diagram of the circuitry of the alarm unit shown in FIGS. 1 and 2.

FIG. 3 illustrates a typical electronic alarm circuit which is placed with the box 10. This alarm circuit is completely self-contained. No external wiring or energy sources are necessary. The alarm consists primarily of a battery 20, which preferably is a replaceable nine volt alkaline battery. Such a battery has a typical two year operating life used in the alarm. The battery 20 is connected in series circuit with a buzzer or siren 21, the anode cathode path of a static latching switch illustrated as a silicon controlled rectifier (SCR) 23, a key operated "arm/disarm" switch 24, a light emitting diode 25 and a load resistor 26. As is well known, the silicon controlled rectifier 23 does not conduct unless a trigger pulse is applied to its gate electrode to cause it to go into an avalanche conducting condition. In such a condition, the circuit shown continously operates the alarm buzzer or siren 21 and illuminates the light emitting diode 25 until the series circuit is broken by operation of the key operated switch 24. With the switch 24 closed to the position shown in FIG. 1, however, the alarm is activated, ready for operation.

The spring biased plungers 12 and 13 are illustrated in their depressed position, holding open a pair of microswitches 30 and 31, respectively, which are connected in parallel with one another to the gate electrode of the silicon controlled rectifier 23. The other side of the switches 30 and 31 is connected through a pair of resistors 33 and 34 and a normally closed switch 36 to the junction between the buzzer 21 and the anode of the silicon controlled rectifier 23. This connection could as well be to the positive terminal of the battery at the junction between the battery and the buzzer 21. The switch 36 is normally closed, enabling the system for operation. With the plungers 12 and 13 in the position shown in FIG. 1, the alarm unit is activated. The plungers 12 and 13 are depressed to the positions shown as 12A and 13A in FIG. 2. The object of art 11 rests upon the top of the box or case for the alarm unit 10, which in turn rests on the table 14.

If the object of art 11 then is removed from the alarm unit 10 and the key switch 24 is closed, as shown in FIG. 1, the spring biased switch 30 pushes the plunger 12 to the position 12B, shown in FIG. 2, and closes the contacts of the switch 30 between the gate of the silicon controlled rectifier 23 and the resistor 33. This applies a positive going "turn-on" pulse to the gate of the silicon controlled rectifier 23, turning it on. Current which then flows through the silicon controlled rectifier 23 also passes through the siren or buzzer 21, sounding the alarm. At the same time, the light emitting diode 25 is illuminated. Even if the object of art 21 is replaced, causing the switch 30 to be opened, the avalanche condition characteristics of the silicon controlled rectifier 23 are such the alarm continues to sound. This is a piercing audible alarm; and in the construction of actual alarm units, a seventy-decibel sound is emitted by the buzzer 21. The alarm can be reset only by opening the switch 24 and then reclosing it after the switches 30 and 31 both are placed in their open condition (depressed plungers 12 and 13), as shown in FIG. 1.

Similarly, if the alarm unit 10 is lifted off the table 14 along with the object of art 11, the lower plunger 13, spring biased to extend out of the bottom of the case of the alarm unit 10, extends to the position 13B, shown in FIG. 2, whereupon the switch contacts 31 are closed to apply a trigger or "turn-on" pulse to the gate electrode of the silicon controlled rectifier 23, causing it to conduct in the same manner described above.

The switch 36 is optional and is not necessary to an operation of the alarm unit described so far. There may be some situations, however, where the switch 36 is desired so that objects may be replaced or changed on an alarm unit 10 without activating the alarm, or an alarm unit 10 may be moved from one position to another without requiring its deactivation by operation of the key switch 24. If this condition is desired, the switch 36 first is opened. This then removes the supply voltage from the switches 30 and 31 and effectively disables the alarm. If the switch 36, however, is opened after the silicon controlled rectifier 23 has been triggered into conduction, as described previously, there is no affect on the operation of the circuits. The switch 36 must be opened before either of the switches 30 and 31 are closed to prevent activation of the alarm system.

In most applications, the switch 36 and the resistor 34 are not necessary. In such an event the left-hand end of the resistor 33 is connected to the junction between the battery and the buzzer 21 to supply operating voltage to the switches 30 and 31.

Figure 4:
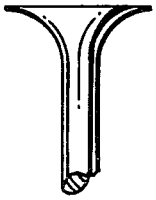
FIG. 4 is a detailed illustration of an alternative embodiment which may be used in place of the plunger components illustrated in FIGS. 1, 2 and 3.

FIG. 4 illustrates an alternative shape which may be used for the plungers 12 and 13 in place of the flat topped rod-like plungers illustrated in FIGS. 1 and 2. The plunger shape of FIG. 4 is intended to thwart would-be thieves who may be aware of the alarm operating characteristics and who would attempt to slide a thin metal or plastic plate under the object of art 11 between it and the alarm to hold the plunger 12 in its depressed condition to permit removal of the object of art 11 without sounding the alarm. The "golf-tee" shape of the upper or outer end of the plungers, as illustrated in FIG. 4, tends to thwart this procedure since moving such a plate underneath the object or underneath the alarm between it and the table would catch the pin on the bevelled portion and then, consequently, would tend to facilitate the extension of the pin out of the alarm unit 10 rather than hold it in.

The alarm unit described above and shown in the drawing is completely self-contained and portable. No external installation is required. In place of self-contained buzzers, however, there may be some installations where the buzzer can be replaced by a transmittor and a receiver with a central alarm in the gallery may be operated in response to the transmission of signals by an individual alarm unit to sound a central alarm throughout the gallery. This is an option which does not affect the other features of operation of the alarm which have been described above. As disclosed, however, the alarm may be used wherever and whenever it is needed, including shows and exhibits which are not at the normal gallery location. Once the alarm is set, it remains in a stand-by condition, not drawing power, until either it or the object of art placed on it is lifted. Then the alarm is energized to perform its intended function. It also should be noted that the light emitting diode 25 (or the buzzer 21) may be eliminated if its function is not desired.

The alarm unit which is shown in the drawings and which has been described above is illustrative of the invention and should be considered as such and not as limiting of the invention. Various changes and modifications will occur to those skilled in the art without departing from the true scope of the invention.

We claim:

1. A portable alarm system for protecting exposed valuables including in combination;

an alarm housing base member having a lower surface for placement on a support member and having an upper article support surface spaced from said lower surface thereof;

alarm means located within said base member;

first means coupled with said alarm means for sensing the removal of the lower surface from a support member for energizing said alarm means; and second means coupled with said alarm means for sensing removal of an article from said upper support surface for energizing said alarm means.

2. The combination according to claim 1 wherein said first means energizes said alarm means in response to removal of the lower surface of said base member from said support member by a first predetermined distance; and said second means energizes said alarm means in response to removal of an article from said upper support surface of said base member by a predetermined distance.

3. The combination according to claim 1 wherein said first and second means comprise first and second weight sensitive switch means, respectively.

4. The combination according to claim 3 wherein said first and second weight sensitive switch means comprise plunger actuated microswitches.

5. The combination according to claim 4 wherein said plunger actuated microswitches each include a plunger normally biased to extend beyond the planes of said lower surface and said upper surface of said base member, respectively; so that upon placement of said base member on a support member, the plunger of said first microswitch is depressed into said base member and upon placement of an article on said upper support surface, the plunger of said second microswitch is depressed into said base member to place said alarm means in an activated condition, whereupon removal of said lower surface of said alarm means from the support member permits the plunger of said first switch means to be biased outwardly from said lower surface of said base member to energize said alarm means, and whereupon removal of an article from said upper support surface permits the plunger for said second microswitch to extend outwardly from said upper support surface to energize said alarm means.

6. The combination according to claim 5 further including means for preventing deenergization of said alarm means by replacing an article on said upper support surface and by replacing said base member on a support member after removal.

7. The combination according to claim 6 wherein said latter means includes a static latching switch means connected in series circuit with said alarm means and a power supply for said alarm means, and said first and second switch means are coupled in circuit with said static latching switch means for triggering said static latching switch means into conduction.

8. The combination according to claim 7 wherein said static latching switch means has a control gate coupled with said first and second microswitches, and said first and second microswitches are connected between said control gate and a source of operating potential, so that said first and second microswitch means apply gating trigger pulses to said control gate of said static latching switch in response to removal of said base member from a support surface or removal of an article from said upper support surface of said base member, respectively.

9. The combination according to claim 8 further including an alarm system activate/deactivate switch in series circuit with said static latching switch and said power supply, said activate/deactivate switch having first and second conditions of operations, said first condition of operation enabling said static latching switch for conducting current therethrough and said second condition of operation opening the current conductive path in series with said static latching switch.

10. The combination according to claim 9 wherein said activate/deactivate switch comprises a key operated switch.

* * * * *